United States Patent [19]

Miyakawa et al.

[11] Patent Number: 4,504,562

[45] Date of Patent: Mar. 12, 1985

[54] ONE-COMPONENT TYPE MAGNETIC DEVELOPER COMPRISES PARTICLES OF CUBIC MAGNETITE

[75] Inventors: Nobuhiro Miyakawa; Masanori Fujii, both of Suita; Kouzi Maekawa, Kyoto, all of Japan

[73] Assignee: Mita Industrial Co., Ltd., Osaka, Japan

[21] Appl. No.: 507,901

[22] Filed: Jun. 27, 1983

Related U.S. Application Data

[63] Continuation of Ser. No. 324,603, Nov. 24, 1981, abandoned.

[30] Foreign Application Priority Data

Nov. 27, 1980 [JP] Japan ..... 55/168527
Dec. 2, 1980 [JP] Japan ..... 55/169150

[51] Int. Cl.[3] ..... G03G 9/14

[52] U.S. Cl. ..... 430/106.6; 430/903; 430/111; 252/62.54; 428/407

[58] Field of Search ..... 430/106.6, 903, 111; 252/62.54

[56] References Cited

U.S. PATENT DOCUMENTS

| | | | |
|---|---|---|---|
| 2,965,573 | 12/1960 | Gundlach | 430/111 |
| 3,234,017 | 2/1966 | Heyl | 430/109 X |
| 3,520,811 | 7/1970 | Swoboda | 430/106.6 |
| 4,031,021 | 6/1977 | Deming . | |
| 4,142,981 | 3/1979 | Bean et al. | 430/109 |
| 4,165,393 | 8/1979 | Suzuki et al. | 427/18 |
| 4,218,530 | 8/1980 | Lu | 430/106.6 X |
| 4,220,698 | 2/1980 | Brynbo et al. | 430/106.6 |
| 4,239,845 | 12/1980 | Tanaka et al. | 430/122 |
| 4,272,600 | 6/1981 | Sypula et al. | 430/106 |
| 4,277,552 | 7/1981 | Asanae et al. | 430/106.6 X |
| 4,311,779 | 2/1982 | Miyakawa et al. . | |
| 4,315,064 | 2/1982 | Miyakawa et al. | 430/122 |
| 4,331,757 | 5/1982 | Tanaka et al. | 430/122 |
| 4,345,014 | 8/1982 | Oka et al. | 430/122 |

FOREIGN PATENT DOCUMENTS

| | | |
|---|---|---|
| 2847768 | 5/1979 | Fed. Rep. of Germany . |
| 2074745 | 11/1981 | United Kingdom . |

*Primary Examiner*—John D. Welsh
*Attorney, Agent, or Firm*—Sherman & Shalloway

[57] ABSTRACT

Disclosed is a one-component type magnetic developer consisting essentially of a particulate shaped article of a composition comprising a binder resin medium and a powdery magnetic material dispersed in the binder resin medium, wherein said magnetic material comprising (A) a non-pulverizing agglomerate of cubic particles of magnetite having a particle size of 1 to 10 μm as measured by an electron microscope and (B) magnetite particles having a particle size of 0.2 to 1 μm at an (A)/(B) weight ratio of from 95/5 to 10/90, especially from 95/5 to 30/70.

5 Claims, 2 Drawing Figures

1 μ

ONE-COMPONENT TYPE MAGNETIC DEVELOPER COMPRISES PARTICLES OF CUBIC MAGNETITE

This application is a continuation of application Ser. No. 324,603, filed Nov. 24, 1981.

BACKGROUND OF THE INVENTION (1) Field of the Invention:

The present invention relates to an improvement in powdery one component magnetic developers. More particularly, the present invention relates to a one-component type magnetic developer for electrophotography, which is excellent in the image density, the color hue, the image sharpness, the resolving power and the half tone-reproducing property.

(2) Description of the Prior Art:

As the developer capable of developing an electrostatic latent image without using a particular carrier, there is known a so-called one-component magnetic developer comprising a powder of a magnetic material contained in developer particles.

As one type of this one-component magnetic developer, there is known a so-called conductive magnetic developer in which a fine powder of a magnetic material is incorporated in developer particles to impart a property of being magnetically attracted and a conducting agent such as carbon black is distributed on the surfaces of the particles to impart them electrically conductive (see, for example, the specifications of U.S. Pat. No. 3,639,245 and U.S. Pat. No. 3,965,022). When this conductive magnetic developer is brought in the form of a so-called magnetic brush into contact with an electrostatic latent image-carrying substrate to effect development of the latent image, there can be obtained an excellent visible image free of a so-called edge effect or fog. However, as is well known, when the developer image is transferred to an ordinary transfer sheet from the substrate, a serious problem arises. More specifically, as described in Japanese Patent Application Laid-Open Specification No. 117435/75, when the inherent electric resistance of a transfer sheet used is lower than $3\times10^{13}$ Ω-cm as in case of plain paper, broadening of contour or reduction of the transfer efficiency is caused by scattering of developer particles at the transfer step. This disadvantage is moderated to some extent by coating the toner-receiving surface of the transfer sheet with a resin, wax or oil having a high electric resistance. This improvement, however, is reduced under a high-humidity condition. Furthermore, the cost of the transfer sheet is increased by coating with a resin or the like and the feel of the transfer sheet is reduced.

As another type of the one-component magnetic developer, there is known a non-conductive magnetic developer comprising an intimate particulate mixture of a fine powder of a magnetic material and an electroscopic binder. For example, the specification of U.S. Pat. No. 3,645,770 discloses an electrostatic photographic reproduction process in which a magnetic brush (layer) of the above-mentioned non-conductive magnetic developer is charged with a polarity opposite to the polarity of the charge of an electrostatic latent image to be developed by means of corona discharge, the charged developer is brought into contact with a latent image-carrying substrate to develop the latent image and the developer image is transferred onto a transfer sheet. This electrostatic photographic reproduction process is advantageous in that a transfer image can be formed even on plain paper as the transfer sheet. However, this process is still disadvantageous in that it is difficult to uniformly charge the magnetic brush of the non-conductive magnetic developer even to the base portion thereof, it is generally difficult to form an image having a sufficient density and the apparatus becomes complicated because a corona discharge mechanism should be disposed in the developing zone.

Recently, there have been proposed a process in which an electrostatic latent image is developed by frictional charging of a non-conductive magnetic developer by frictional contact of the developer with the surface of a latent image-carrying substrate (see Japanese Patent Application Laid-Open Specification No. 62638/75) and a process in which development is effected by utilizing dielectric polarization of a non-conductive magnetic developer (see Japanese Patent Application Laid-Open Specification No. 133026/76). In the former process, however, if development conditions are not strictly controlled, fogging is readily caused (especially when the degree of the contact of the tip of the spike of magnetic toner particles with the surface of the photosensitive material is high) or fixing or blocking of the magnetic toner particles onto the developing sleeve is caused, and this undesirable phenomenon is especially conspicuous when the copying operation is conducted continuously. In the latter process, there does not arise the problem of fogging, but since a visible image is formed by developing a latent image by utilizing the dielectric polarizing effect induced in the magnetic toner, the low-potential area of the latent image is not effectively developed. Accordingly, in the resulting print, a low-density portion of an original is hardly reproduced and reproduction of a half tone is difficult. Moreover, prints obtained according to these two processes are poor in the image sharpness, and when a p-type photosensitive material such as selenium is used as the photosensitive plate and a positively charged image is developed, it is very difficult to obtain an image having a sufficient density according to any of the foregoing two processes.

Furthermore, the specification of U.S. Pat. No. 4,102,305 discloses a process in which a one-component type magnetic developer, the electric resistance of which changes depending on the intensity of the electric field, namely a one-component type magnetic developer which becomes substantially conductive in a high electric field but has a high electric resistance in a low electric field, is used, a high voltage is applied between a magnetic brush-forming sleeve and a photosensitive plate to effect development under such conditions that the developer particles become conductive and transfer of the developer particles to a transfer sheet is carried out in a low electric field or in an electric field-free state to obtain an excellent transferred image. This specification teaches that the above-mentioned developer having a high electric field dependency of the electric resistance is prepared by spray-granulating 50% by weight of stearate-coated magnetite and 50% by weight of a styrene/n-butyl methacrylate copolymer. This process is excellent in the above idea of obtaining a good transferred image, but this process is disadvantageous in that a peculiar high voltage apparatus is necessary for the development and though the formed image has a high density, the image sharpness is still insufficient.

Moreover, the specification of U.S. Pat. No. 4,121,931 discloses a process in which an electrically insulating one-component magnetic developer is used, a magnetic brush-forming sleeve is used as an electrode and a voltage is applied between this electrode and a photosensitive plate to cause a turbulent agitation in the developer on the sleeve, whereby the developer particles are uniformly charged. This process, however, is disadvantageous in that a high voltage apparatus should be disposed in the developing zone and special means should be disposed to agitate the developer particles on the sleeve.

As will be apparent from the foregoing description, the conventional researches made on one-component magnetic developers and developing processes using these developers are concentrated to the composition of the developer, the developer-preparing process and the process for charging developer particles, but properties of magnetite to be incorporated into the developer have hardly been studied.

Ordinarily, when a magnetic brush of a one-component developer is brought into contact with the surface of an electrostatic latent image-carrying substrate, the individual developer particles receive an electrostatic attracting force (Coulomb force) acting between the developer particles and the electrostatic latent image and a magnetic attracting force acting between the developer particles and a magnetic brush-forming magnet. The developer particles on which the Coulomb force is larger are attracted to the electrostatic latent image, while the developer particles on which the magnetic attracting force is larger are attracted to the magnetic sleeve, with the result that development is effected according to the electrostatic latent image on the substrate. Therefore, it is required for the one-component type magnetic developer that a certain balance should be maintained between magnetic characteristics and charging characteristics at the development step. Accordingly, it will readily be understood that the characteristics of the magnetic material powder used for the one-component magnetic developer have important influences on the characteristics of an image which will be formed.

SUMMARY OF THE INVENTION

In accordance with the present invention, there is provided a one-component type magnetic developer consisting essentially of a particulate shaped article of a composition comprising a binder resin medium and a powdery magnetic material dispersed in the binder resin medium, wherein said magnetic material comprises (A) a non-pulverizing agglomerate of cubic particles of magnetite having a particle size of 1 to 10 μm as measured by an electron microscope and (B) magnetite particles having a particle size of 0.2 to 1 μm at an (A)/(B) weight ratio of from 95/5 to 10/90, especially from 95/5 to 30/70.

DETAILED DESCRIPTION OF THE PREFERRED EMBODIMENTS

When the above-mentioned non-pulverizing agglomerate of magnetite particles is used as a part of the magnetite of the one-component type magnetic developer, the image sharpness and resolving power can highly be improved over the conventional one-component magnetic developers including magnetite of the needle or cubic crystal form or indeterminate-shape magnetite, and furthermore, the reproducibility of a half tone can also be improved. When the above-mentioned agglomerated particles of magnetite are combined at a specific weight ratio with fine magnetite particles having a particle size of 0.2 to 1 μm and the mixture is used as the powdery magnetic material, the image density can be improved remarkably over the image density attained when either of the first and second magnetite components is singly used, and the color hue of the formed image can be made purely black or substantially purely black.

Figure 1:
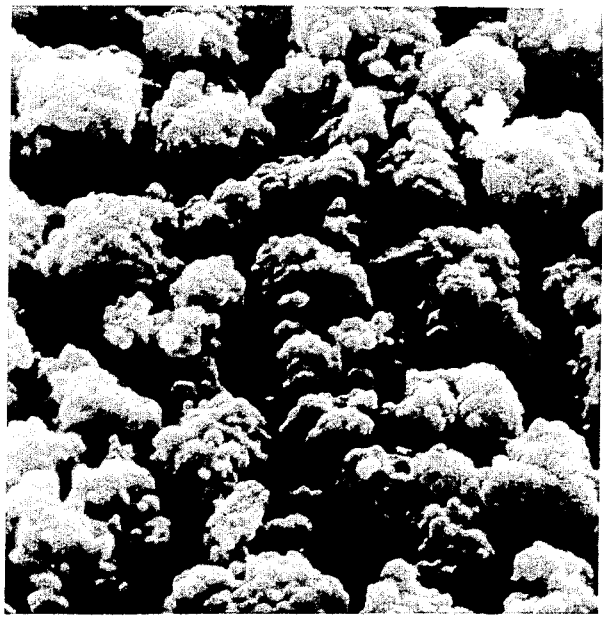
FIG. 1 is an electron microscope photograph of a non-pulverizing agglomerate of cubic particles, which is used for the first developer component of the powdery magnetic material of the present invention.
Figure 2:
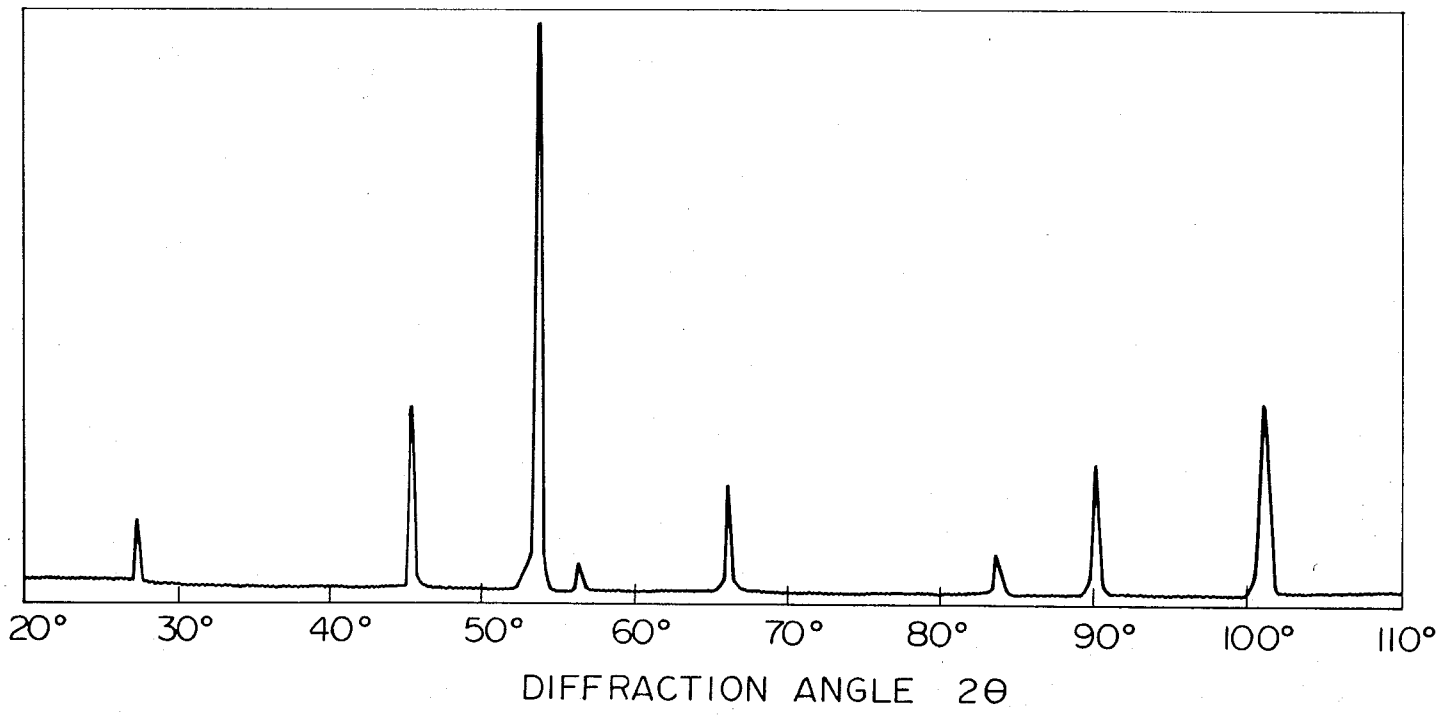
FIG. 2 shows an X-ray diffraction pattern of the agglomerate shown in FIG. 1.

As is seen from the electron microscope photograph of FIG. 1 and the X-ray diffraction pattern of FIG. 2, the first component of the powdery magnetic material used in the present invention is magnetite consisting of a non-pulverizing agglomerate of cubic particles.

By the term "non-pulverizing agglomerate" used in the instant specification and appended claims is meant an agglomerate of fine particles which are densely aggregated with one another as shown in FIG. 1 and in which the particle size distribution is not substantially changed even by an ordinary pulverizing treatment, for example, 5 hours' ball-milling treatment.

This non-pulverizing agglomerate has an average particle size of 1 to 10 microns, especially 2 to 7 microns, as measured by an electron microscope. Namely, it has a particle size larger than the particle size of ordinary magnetite particles.

Since the first component of the magnetic material used in the present invention has the above-mentioned dense aggregate structure and a relatively coarse particle size, the volume per unit weight, namely the bulk, is smaller than that of particles of magnetite of the cubic or needle crystal form or indeterminate-shape magnetite heretofore used for one-component type magnetic developers. Accordingly, in the one-component type magnetic developer of the present invention, the resin/magnetite volume ratio can be made much higher than that in the conventional one-component magnetic developers when the comparison is made based on the same weight ratio of magnetite. Accordingly, as will readily be understood, in the one-component type magnetic developer of the present invention, much higher inherent charging characteristics can be given to the resin.

It has been known that a polymeric material having a larger dielectric constant is more readily positively charged (see The Society of Photographic Scientists and Engineers, 2nd Int. Conf., 1974, pages 95 to 100). It has been found by us that in a magnetic developer comprising a powdery magnetic material dispersed in a binder medium, if the dielectric constant of the magnetic developer is small, it is likely to be negatively charged by friction, and that if the dielectric constant is large, the magnetic material is likely to be positively charged by friction. More practically, developer particles comprising magnetite in an amount of 55% by weight based on the total developer have a dielectric constant of 3.85 to 4.05, whereas magnetic developer particles comprising 55% by weight of the above-mentioned non-pulverizing agglomerate of cubic particles have a dielectric constant of 3.79. Accordingly, it has been confirmed that the magnetic developer of the present invention is more readily negatively charged.

As pointed out hereinbefore, the first component of the powdery magnetic material used in the present invention has a smaller bulk, that is, a larger apparent density, than ordinary magnetite. More specifically, the powdery magnetic material has an apparent density of 0.5 to 1.5 g/ml, especially 0.7 to 1.3 g/ml, as determined according to the method of JIS K-5101.

The non-pulverizing agglomerate of cubic particles has magnetic characteristics of a saturation magnetization of 75 to 88 emu/g, a residual magnetization of 3 to 12 emu/g and a coercive force of 40 to 150 Oe.

The non-pulverizing agglomerate of cubic particles used in the present invention is prepared according to the following method, though an applicable method is not limited to this method.

A weakly alkaline aqueous solution, for example, aqueous ammonia, is added to an aqueous solution of iron (III) sulfate to form precipitates of iron (III) hydroxide. The precipitates are subjected to a hydrothermal treatment under pressure while maintaining the pH value of the mother liquor at 3 to 9, whereby gel-like precipitates of iron hydroxide are changed to cubic particles of $\alpha$-$Fe_2O_3$ (hematite). If the weakly alkaline aqueous solution is used to maintain the pH value of the mother liquor to a level close to the acidic side, fine cubic particles which tend to aggregate are formed, and the so-obtained particles are aged by carrying out the hydrothermal treatment at 150° to 230° C. for a long time, for example, more than 50 hours, whereby $\alpha$-diiron trioxide having the configuration specified in the present invention can be obtained. If this $\alpha$-diiron trioxide is reduced under known conditions, for example, by heating it at 400° C. with hydrogen in a reducing furnace, triiron tetroxide ($Fe_3O_4$) having the configuration specified in the present invention can be obtained. The reducing treatment is ordinarily carried out so that the $Fe^{2+}/Fe^{3+}$ atomic ratio is in the range of from 0.9/1.0 to 1.1/1.0. Thus, triiron tetroxide having the above-mentioned specific fine-structure can be obtained.

The X-ray diffraction pattern of the magnetite used as the first component of the magnetic material in the present invention is the same as that of ordinary magnetite of the cubic crystal form and in view of the height of the diffraction peak, it has been confirmed that the magnetite used in the present invention is not substantially different from ordinary magnetite of the cubic crystal form in the degree of crystallization.

In the present invention, the above-mentioned agglomerate type magnetite (A) is combined with fine magnetite particles (B) having a particle size of 0.2 to 1 $\mu$m at an (A)/(B) weight ratio of from 95/5 to 10/90, preferably from 95/5 to 30/70, especially preferably from 90/10 to 40/60. When both the components are combined at the above-mentioned weight ratio and used as the magnetic material, the image density is highly improved over the image density attainable by single use of either of the two components. Moreover, this increase of the image density can be attained without impairing the advantages of the non-pulverizing agglomerate of magnetite. The non-pulverizing agglomerate of magnetite is especially suitable for attaining the objects of improving the image sharpness, resolving power and half tone-reproducing property. However, this developer component is still insufficient in that an image of a color hue deviating from pure black, that is, a slightly brownish black, is often given. According to the present invention, by combining this agglomerated magnetite with the second magnetite component having a fine particle size, an image having a pure-black color or substantially pure-black color can be obtained.

Magnetite of the needle or cubic crystal form or indeterminate-shape magnetite can optionally be used as the second magnetite component if the particle size is in the range of from 0.2 to 1 $\mu$m, preferably from 0.3 to 0.8 $\mu$m. Such form of magnetite depends on the crystal form of starting $\alpha$-diiron trioxide (hematite).

Such fine magnetite particles have a large bulk because the particle size is fine, and the apparent density is in the range of from 0.2 to 0.45 g/ml as determined according to the method of JIS K-5101.

In a preferred embodiment of the present invention, magnetite which has such a high apparent density as exceeding 0.45 g/ml though the number average particle size is not larger than 1 micron, especially in the range of from 0.1 to 0.7 $\mu$m, is used as the second magnetite component. In ordinary magnetite, the apparent density tends to decrease with reduction of the particle size. If magnetite particles having a fine particle size and a small apparent density are used in combination with the first magnetite component consisting of the above-mentioned agglomerate of magnetite particles, the object of obtaining an image having a pure-black color or substantially pure-black color can be attained. However, in this case, the object of improving the image density at a high-speed development is not satisfactorily attained. Namely, if development is carried out at a high speed by using the above developer, the image density is lower than the image density obtained when development is carried out at a low speed. In contrast, according to the above-mentioned preferred embodiment of the present invention, by selecting specific magnetite having a fine particle size and a relatively large apparent density and combining this magnetite with the above-mentioned agglomerate of magnetite particles, a magnetic developer which can be applied to high-speed development, that is, high-speed reproduction, can be provided and prominent increase of the image density at high-speed development can be attained without impairing the advantages attained by the non-pulverizing agglomerate of magnetite.

The fine magnetite used in the above-mentioned preferred embodiment consists ordinarily of cubic particles and/or slightly rounded indeterminate-shape particles, and the shape anisotropy defined as the ratio of the maximum size to the minimum size is in the range of from 1.0 to 5.5, preferably from 1 to 3.

The fine magnetite particles (B) having the above-mentioned characteristics are prepared according to the following method, though an applicable method is not limited to this method.

An alkaline aqueous solution of sodium hydroxide is added to an aqueous solution of iron (III) sulfate to form precipitates of iron (III) hydroxide. The precipitates are subjected to a hydrothermal treatment under pressure while maintaining the pH value of the mother liquior at 4 to 11, whereby gel-like precipitates of iron hydroxide are changed to cubic particles of $\alpha$-$Fe_2O_3$ (hematite). Conditions for the preparation of this cubic $\alpha$-diiron trioxide are described in detail, for example, in Nobuoka et al., Kogyo Kagaku Zasshi, 66, page 412 (1963). The hydrothermal treatment may be carried out at a temperature of 150° to 230° C. for 10 to 100 hours. Ordinarily, a higher pH value of the mother liquor results in a larger particle size. If not only the pH value of the mother liquor but also the treatment temperature and the treatment time are appropriately adjusted, α-diiron trioxide having a prededermined particle size is obtained. If this α-diiron trioxide is reduced under known conditions, for example, by heating it at 400° C. with hydrogen in a reducing furnace, triiron tetroxide ($Fe_3O_4$) having a cubic crystal form or a slightly rounded indeterminate shape can be obtained. The reducing treatment is ordinarily carried out so that the $Fe^{2+}/Fe^{3+}$ atomic ratio is in the range of from 0.9/1.0 to 1.1/1.0. Thus, triiron tetroxide having the above-mentioned characteristics can be obtained.

In preparation of the above-mentioned α-diiron trioxide as the precursor, if the hydrothermal treatment is carried out at a relatively low pH value, magnetite having a slightly rounded indeterminate-shape where corners of cubes are removed is obtained. Such magnetite particles can be used in the present invention as well as magnetite particles of the cubic crystal form.

As the binder medium for dispersing the above-mentioned composite magnetite, there can be used resins, waxy materials or rubbers which show a fixing property under application of heat or pressure. These binder medium may be used singly or in the form of a mixture of two or more of them. It is preferred that the volume resistivity of the binder medium be at least $1\times10^{15}$ Ω-cm as measured in the state where magnetite is not incorporated.

As the binder medium, there are used homopolymers and copolymers of mono- and di-ethylenically unsaturated monomers, especially (a) vinyl aromatic monomers and (b) acrylic monomers.

As the vinyl aromatic monomer, there can be mentioned monomers represented by the following formula:

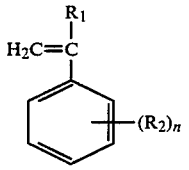

wherein $R_1$ stands for a hydrogen atom, a lower alkyl group (having up to 4 carbon atoms) or a halogen atom, $R_2$ stands for a substituent such as a lower alkyl group or a halogen atom, and n is an integer of up to 2 inclusive of zero, such as styrene, vinyl toluene, alpha-methylstyrene, alpha-chlorostyrene, vinyl xylene and vinyl naphthalene. Among these vinyl aromatic monomers, styrene and vinyl toluene are especially preferred.

As the acrylic monomer, there can be mentioned monomers represented by the following formula:

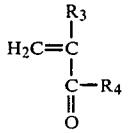

wherein $R_3$ stands for a hydrogen atom or a lower alkyl group, and $R_4$ stands for a hydroxyl group, an alkoxy group, a hydroxyalkoxy group, an amino group or an aminoalkoxy group, such as acrylic acid, methacrylic acid, ethyl acrylate, methyl methacrylate, butyl acrylate, butyl methacrylate, 2-ethylhexyl acrylate, 2-ethylhexyl methacrylate, 3-hydroxypropyl acrylate, 2-hydroxyethyl methacrylate, 3-aminopropyl acrylate, 3-N,N-diethylaminopropyl acrylate and acrylamide.

As another monomer to be used singly or in combination with the above-mentioned monomer (a) or (b), there can be mentioned, for example, conjugate diolefin monomers represented by the following formula:

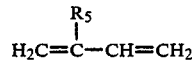

wherein $R_5$ stands for a hydrogen atom, a lower alkyl group or a chlorine atom, such as butadiene, isoprene and chloroprene.

As still another monomer, there can be mentioned ethylenically unsaturated carboxylic acids and esters thereof such as maleic anhydride, fumaric acid, crotonic acid and itaconic acid, vinyl esters such as vinyl acetate, and vinyl pyridine, vinyl pyrrolidone, vinyl ethers, acrylonitrile, vinyl chloride and vinylidene chloride.

It is preferred that the molecular weight of such vinyl type polymer be 3,000 to 300,000, especially 5,000 to 200,000.

In the present invention, it is preferred that the above-mentioned agglomerate be used in an amount of 35 to 75% by weight, especially 40 to 70% by weight, based on the sum of the amounts of the binder medium and the magnetic material. Magnetite is uniformly and homogeneously kneaded with the binder medium and the kneaded composition is granulated, whereby the intended one-component type magnetic developer is obtained.

Known auxiliary components for developers may be added according to known recipes prior to the above-mentioned kneading and granulating steps. For example, pigments such as carbon black and dyes such as Acid Violet may be added singly or in combination in amounts of 0.5 to 5% by weight based on the total composition so as to improve the hue of the developer. Furthermore, a filler such as calcium carbonate or powdery silica may be added in an amount of up to 20% by weight based on the total composition to obtain a bulking effect. In the case where fixing is effected by a heat roll, an offset-preventing agent such as a silicone oil, a low-molecular-weight olefin resin or a wax may be used in an amount of 2 to 15% by weight based on the total composition. In the case where fixing is effected by means of a pressure roll, a pressure fixability-improving agent such as paraffin wax, an animal or vegetable wax or a fatty acid amide may be used in an amount of 5 to 30% by weight based on the total composition. Furthermore, in order to prevent cohesion or agglomeration of developer particles and improve the flowability thereof, a flowability-improving agent such as a fine powder of polytetrafluoroethylene or finely divided silica may be added in an amount of 0.1 to 1.5% by weight based on the total composition.

Shaping of the developer can be accomplished by cooling the above-mentioned kneaded composition, pulverizing the composition and, if necessary, classifying the pulverization product. Mechanical high-speed stirring may be conducted so as to remove corners of indeterminate-shape particles.

It is ordinarily preferred that the average particle size of the developer particles be in the range of 5 to 35 μm, though the particle size of the developer particles is changed to some extent according to the intended resolving power. The developer comprising indeterminate-shape particles formed by kneading and pulverization according to the present invention exerts enhanced effects of increasing the transfer efficiency and elevating the image sharpness.

In the electrostatic photographic reproduction process using the developer according to the present invention, formation of an electrostatic latent image can be performed according to any of the known methods. For example, an electrostatic latent image can be formed by uniformly charging a photoconductive layer formed on a conductive substrate and subjecting the photoconductive layer to imagewise exposure.

A visible image of the developer is formed by bringing a magnetic brush of the above-mentioned one-component type magnetic developer into contact with the electrostatic latent image-carrying surface of the substrate.

Development of the electrostatic latent image with the developer of the present invention can be accomplished, for example, according to the following procedures. The above-mentioned one-component type magnetic developer is charged in a developer hopper. A non-magnetic sleeve is rotatably mounted on a lower end opening of the hopper, and a magnet is disposed in the interior of the sleeve so that the magnet turns in a direction opposite to the rotation direction of the sleeve. When the sleeve and magnet are rotated, a brush layer of the magnetic developer is formed on the sleeve, and this brush layer is cut into an appropriate length by a spike-cutting plate. Then, the brush layer of the developer is lightly contacted with a selenium drum which is rotated in the same direction as the rotation direction of the sleeve to develop an electrostatic latent image on the selenium drum with the magnetic developer.

Then, the developer image on the substrate is brought into contact with a transfer sheet, and corona charging is effected from the back surface of the transfer sheet with the same polarity as that of the electrostatic latent image, whereby the developer image is transferred onto the transfer sheet.

In the present invention, fixation of the transferred image may be carried out according to any of a heat roller fixation method, a flash lamp fixation method and a pressure roller fixation method, and an appropriate fixation method is selected according to the kind of the developer.

The developer of the present invention is especially effective for a p-type photosensitive plate on which a positively charged latent image is formed, for example, a selenium photosensitive plate or a photosensitive plate comprising an organic photoconductive material layer. The conventional one-component magnetic developer of the frictional charging type can be applied to a photosensitive plate having a negatively charged latent image, but if this developer is used for developing a positively charged latent image formed on the above-mentioned p-type photosensitive plate, no satisfactory results can be obtained. In contrast, when the developer of the present invention is used, excellent results can be obtained in development and transfer of positively charged latent images.

The present invention will now be described in detail with reference to the following Examples that by no means limit the scope of the invention. All of "parts" and "%" are by weight unless otherwise indicated.

EXAMPLE 1

A composition comprising 38.5 parts of agglomerated magnetite ($Fe_3O_4$) shown in Table 1, 16.5 parts of magnetite E having a coercive force of 72 Oe, an apparent density of 0.40 g/ml and a particle size of 0.3 μm, 37 parts of a styrene/butyl methacrylate copolymer (weight average molecular weight=27,000), 8 parts of low-molecular-weight polypropylene (average molecular weight=4,000) and 0.5 part of zinc stearate was kneaded and molten at 140° C. for 35 minutes by a two-roll kneading device. The kneaded composition was naturally cooled and roughly pulverized to a size of 0.5 to 2 mm by a cutting mill. Then, the roughly pulverized composition was finely pulverized by a jet mill and classified by a zigzag classifying machine to obtain a magnetic toner having a particle size within the range of from 5 to 35 μm. The classification was carried out so that the lower limit of the particle size range was at least 2 times the particle size of magnetite. Then, hydrophobic silica (R-972 supplied by Nippon Aerosil) was added to the so obtained particles in an amount of 0.2% based on the total amount to obtain a magnetic toner.

TABLE 1

| Agglomerated Magnetite | Apparent Density (g/ml) | Number Average Particle Size (μm) | Coercive Force (Oe) | Saturation Magnetization (emu/g) | Residual Magnetization (emu/g) |
|---|---|---|---|---|---|
| A | 0.635 | 1 | 148 | 84.2 | 10.6 |
| B | 0.972 | 3 | 54 | 87.2 | 5.1 |
| C | 1.204 | 5 | 100 | 77.4 | 8.6 |
| D | 0.880 | 7 | 90 | 78.1 | 8.0 |

The so obtained magnetic toners (prepared by using the magnetite shown in Table 1 and the magnetite E in combination) are designated as magnetic toners A', B', C' and D'. For comparison, magnetic toners A", B", C", D" and E' were prepared in the same manner as described above except that either of the magnetites A through E was singly used. Incidentally, the particle size distribution of the toner E' was from 5 to 25 μm.

The values of the magnetic properties shown in Table 1 and subsequent Tables are those measured by using a magnetic property-measuring device supplied by Toei Kogyo (Model VSMP-1, magnetic field=5K-Oe).

The following copying test was carried out by using the so-prepared magnetic toners.

In a copying machine comprising a selenium drum (outer diameter=150 mm) as a photosensitive material, the intensity of a magnetic field on a developing sleeve (outer diameter=33 mm) having a magnet disposed therein through a non-magnetic member was adjusted to about 900 gauss, and the magnetic toner was applied to a developing roller of the so-called two-rotation system capable of rotating the magnet and the sleeve independently, while adjusting the distance between a spike-cutting plate and the sleeve to 0.3 mm. An arrangement was made so that the magnetic toner was supplied to the developing roller zone from a hopper. The distance between the surface of the photosensitive material and the developing roller was adjusted to 0.5 mm. The developing sleeve and photosensitive material were rotated in the same direction, and the magnet was rotated in the opposite direction. Under the foregoing conditions, charging (+6.7 KV), exposure, development, transfer (+6.3 KV), heater roller fixation and fur brush cleaning were performed. Slick paper having a thickness of 80 μm was used as a transfer sheet, and the transfer speed was adjusted to 10 A4-size sheets per minute. The results of the copying test are shown in Table 2. The image density was measured on a solid black portion by using a commercially available reflective densitometer (supplied by Konishiroku Shashin Kogyo). A Copia test pattern supplied by Data Quest Co. was used as a copying test chart, and the gradient characteristic and resolving power were determined from a copy thereof. The sharpness was evaluated based on the line-image portion of the obtained copy and when lines could be distinguished from one another definitely, the sharpness was judged as being excellent.

The obtained results are shown in Table 2.

TABLE 2

| Magnetic Toner | Image Density | Background Density | Color Hue of Image | Sharpness | Resolving Power (lines/mm) | Gradient Characteristic (stages) |
|---|---|---|---|---|---|---|
| A' (present invention) | 1.63 | 0.09 | black | good | 8.0 | 11 |
| B' (present invention) | 1.65 | 0.09 | " | excellent | 8.0 | 12 |
| C' (present) invention) | 1.65 | 0.09 | " | " | 8.0 | 12 |
| D' (present invention) | 1.53 | 0.09 | " | " | 7.1 | 12 |
| E' (present invention) | 1.10 | 0.10 | " | fair | 7.1 | 10 |
| A" (comparison) | 1.53 | 0.09 | bluish black | good | 8.0 | 11 |
| B" (comparison) | 1.54 | 0.10 | bluish black | good to excellent | 8.0 | 12 |
| C" (comparison) | 1.50 | 0.09 | bluish black | good to excellent | 8.0 | 11 |
| D" (comparison) | 1.30 | 0.10 | reddish black | good to excellent | 7.1 | 11 |

Note
The magnetic toners A', B', C' and D' shown in Table 2 are included within the scope of the one-component type magnetic toner of the present invention.

It was found that the magnetic toner of the present invention could directly be applied to a conventional development apparatus using a conventional conductive magnetic toner and plain paper could be used as the transfer sheet, and that the obtained copy had a clear image without broadening of the image or scattering of the toner, which is often observed at the transfer of an image of the conductive magnetic toner. Furthermore, a black image having a high density could be obtained and the reproduction of a half tone was excellent.

EXAMPLE 2

A magnetic toner (having a particle size of 6 to 20 μm) having a composition shown in Table 4 was prepared in the same manner as described in Example 1 by using agglomerated magnetite having an apparent density of 0.735 g/ml, a number average particle size of 2.8 μm a coercive force of 58 Oe, a saturation magnetization of 87.2 emu/g and a residual magnetization of 5.1 emu/g and magnetite shown in Table 3 in combination.

TABLE 3

| Magnetite | Coercive Force (Oe) | Apparent Density (g/ml) | Particle Size (μ) | Remarks |
|---|---|---|---|---|
| (1) | 64 | 0.40 | 0.3–0.6 | cubic crystal |

TABLE 3-continued

| Magnetite | Coercive Force (Oe) | Apparent Density (g/ml) | Particle Size (μ) | Remarks |
|---|---|---|---|---|
| (2) | 350 | 0.40 | 0.5–0.6 (length), 0.06–0.1 (width) | needle crystal |
| (3) | 85 | 0.37 | 0.3–0.4 | cubic crystal |
| (4) | 134 | 0.31 | 0.27 | indeterminate-shape |

TABLE 4

| Magnetic Toner | Agglomerated Magnetite | Mixing ratio (parts) | | |
|---|---|---|---|---|
| | | Magnetite Shown in Table 3 | Thermo-plastic Resin | High Density Polyethylene |
| F | 21 | (1), 49 | 24 | 6 |
| G | 30 | (3), 30 | 32 | 8 |
| H | 35 | (2), 15 | 40 | 10 |
| I | 36 | (4), 4 | 48 | 12 |

In each composition, zinc stearate was incorporated in an amount of 0.6 part. As the thermoplastic resin, a styrene/acrylic copolymer having a weight average molecular weight of 71,000 was used, and the high density polyethylene used had an average molecular weight of 4,000.

The following copying test was carried out by using the so-obtained magnetic toners.

In a copying machine comprising a selenium drum as a photosensitive material, the magnetic toner was applied to a developing roller having a magnetic disposed therein through a non-magnetic member while adjusting the distance between a spike-cutting plate and the developing roller to 0.3 mm. The distance between the surface of the photosensitive material and the developing roller was adjusted to 0.5 mm. The developing roller and photosensitive material were rotated in the same direction, but the moving speed of the developing roller was 2 times as high as the moving speed of the photosensitive material. Under the foregoing conditions, charging, exposure, development and heat fixation were performed. Slick paper having a thickness of 80 μm was used as a transfer sheet. The transfer speed was adjusted to 10 A4-size sheets per minutes. The results of the copying test are shown in Table 5. The image density was measured on a solid black portion.

TABLE 5

| Magnetic Toner | Image Density | Background Density | Color Hue of Image | Sharpness | Resolving Power (lines/mm) | Gradient Characteristic (steps) |
|---|---|---|---|---|---|---|
| F | 1.43 | 0.09 | black | good | 8.0 | 11 |
| G | 1.57 | 0.09 | " | excellent | 8.0 | 12 |
| H | 1.60 | 0.09 | " | " | 8.0 | 12 |
| I | 1.58 | 0.12 | " | " | 7.1 | 12 |

The obtained copies had a black image excellent in the sharpness, and the half tone-reproducing property was excellent. It was found that if the total magnetite content was lower than 40% based on the sum of the binder resin medium and the magnetic material, fogging became conspicuous, and if the total magnetite content was higher than 70%, reduction of the image density was observed.

By using the one-component type magnetic toner H, 10000 copies were formed by carrying out the copying operation continuously. In each of the obtained copies, the image density was higher than 1.55. In this case, the copying operation was conducted without fogging in a stable condition.

When the copying operation was carried out by using the toner prepared by using the agglomerated magnetite alone, the color hue of the obtained image was not purely black but was bluish black. When the toners prepared by using the four magnetites shown in Table 3 were used, the image density was generally low and the gradient characteristic was inferior in the obtained copies.

EXAMPLE 3

A composition comprising 38.5 parts of agglomerated magnetite ($Fe_3O_4$) shown in Table 1, 16.5 parts of magnetite J having a coercive force of 213 Oe, an apparent density of 0.55 g/ml and a particle size of 0.4 to 0.5 μm, 37 parts of a styrene/butyl methacrylate copolymer having a weight average molecular weight of 27,000, 0.6 part by weight of a negative charge controlling agent (Spilon Black BHH supplied by Hodogaya Kagaku), 0.5 part of zinc stearate and 8 parts of low-molecular-weight polypropylene (average molecular weight=4,000) was kneaded and molten at 140° C. for 35 minutes by means of a two-roll mill. The kneaded composition was naturally cooled and roughly pulverized to 0.5 to 2 mm. Then, the pulverized composition was finely pulverized by a jet mill and classified by a zigzag classifying machine to obtain a magnetic toner having a particle size of 5 to 35 μm. Classification was performed to collect particles having a minimum particle size at least 2 times the particle size of the magnetite, and the particles were mixed with hydrophobic silica (R-972 supplied by Nippon Aerosil) in an amount of 0.2% based on the total amount to form a magnetic toner.

The so-prepared magnetic toners were designated as magnetic toners A''', B''', C''' and D''' (formed by using the magnetite shown in Table 1 and the magnetite J). For comparison, magnetic toners A'', B'', C'', D'' and J' were prepared by using these magnetites singly as the magnetic material. Incidentally, the magnetic toner J', the particle size distribution was from 5 to 25 μm.

The following copying test was carried out by using the so-prepared magnetic toners.

In a copying machine comprising a selenium drum (outer diameter=150 mm) as a photosensitive material, the intensity of a magnetic field on a developing sleeve (outer diameter=33 mm) having a magnet disposed therein through a non-magnetic member was adjusted to about 900 gauss, and the magnetic toner was applied to a developing roller of the so-called two-rotation system capable of rotating the magnet and the sleeve independently, while adjusting the distance between a spike-cutting plate and the sleeve to 0.3 mm. An arrangement was made so that the magnetic toner was supplied to the developing roller zone from a hopper. The distance between the surface of the photosensitive material and the developing roller was adjusted to 0.5 mm. The developing sleeve and photosensitive material were rotated in the same direction, and the magnet was rotated in the opposite direction. Under the foregoing conditions, charging (+6.7 KV), exposure, development, transfer (+6.3 KV), heater roller fixation and fur brush cleaning were performed. Slick paper having a thickness of 80 microns was used as a transfer sheet, and the transfer speed was adjusted to 30 A4-size sheets per minute. The results of the copying test are shown in Table 6. The image density was measured on a solid black portion by using a commercially available reflective densitometer (supplied by Konishiroku Shashin Kogyo). A Copia test pattern supplied by Data Quest Co. was used as a copying test chart, and the gradient characteristic and resolving power were determined from a copy thereof. The sharpness was evaluated based on the line-image portion of the obtained copy and when lines could be distinguished from one another definitely, the sharpness was judged as being excellent.

It was found that the magnetic toner of the present invention could directly be applied to a conventional development apparatus using a conventional conductive magnetic toner and plain paper could be used as the transfer sheet, and that the obtained copy had a clear image without broadening of the image or scattering of the toner, which is often observed at the transfer of an image of the conductive magnetic toner. Furthermore, copies having a high image density and a clear and sharp image of a pure-black color were obtained at a copying speed of 30 sheets (A4-size sheets) without impairing the half tone-reproducing property or the resolving power.

TABLE 6

| Magnetic Toner | Image Density | Background Density | Color Hue of Image | Sharpness | Resolving Power (lines/mm) | Gradient Characteristic (steps) |
|---|---|---|---|---|---|---|
| A''' (present invention) | 1.59 | 0.09 | black | excellent | 8.0 | 11 |

TABLE 6-continued

| Magnetic Toner | Image Density | Background Density | Color Hue of Image | Sharpness | Resolving Power (lines/mm) | Gradient Characteristic (steps) |
|---|---|---|---|---|---|---|
| B''' (present invention) | 1.62 | 0.09 | " | " | 8.0 | 12 |
| C''' (present) invention) | 1.64 | 0.09 | " | " | 8.0 | 12 |
| D''' (present invention) | 1.60 | 0.09 | " | " | 7.1 | 12 |
| J' (comparison) | 0.70 | 0.09 | " | fair | 6.3 | 10 |
| A'' (comparison) | 1.42 | 0.09 | bluish black | good | 8.0 | 11 |
| B'' (comparison) | 1.43 | 0.10 | bluish black | excellent | 8.0 | 12 |
| C'' (comparison) | 1.40 | 0.09 | bluish black | " | 8.0 | 11 |
| D'' (comparison) | 1.39 | 0.10 | reddish black | " | 7.1 | 11 |

EXAMPLE 4

By using agglomerated magnetite (apparent density=0.735 g/ml, number average particle size=2.8 μm, coercive force=58 Oe, saturation magnetization=87.2 emu/g, residual magnetization=5.1 emu/g) and a magnetite shown in Table 7, magnetic toners (particle size of 6 to 20 μm) aving a composition shown in Table 8 were prepared in the same manner as described in Example 1.

TABLE 7

| Magnetite | Coercive Force (Oe) | Apparent Density (g/ml) | Particle Size (μ) | Remarks |
|---|---|---|---|---|
| K | 135 | 0.71 | 0.1-0.2 | indeterminate-shape |
| L | 49 | 0.47 | 0.4 | cubic crystal |
| M | 56 | 0.71 | 0.5 | " |
| N | 90 | 0.95 | 0.47 | " |
| O | 200 | 0.75 | 0.5 | " |

TABLE 8

| Magnetic Toner | Composition (parts by weight) Agglomerated Magnetite | Magnetite Shown in Table 3 | Thermoplastic Resin | Zinc Stearate | Negative Charge Controlling Agent | High Density Polyethylene |
|---|---|---|---|---|---|---|
| P | 10.5 | N, 59.5 | 24 | 0.6 | 0.8 | 6 |
| Q | 30 | L, 30 | 32 | 0.6 | 0.8 | 8 |
| R | 44 | K, 11 | 36 | 0.6 | 0.8 | 9 |
| S | 20 | M, 30 | 40 | 0.6 | 0.8 | 10 |
| T | 36 | O, 4 | 48 | 0.6 | 0.8 | 12 |

As the thermoplastic resin, a styrene/acrylic copolymer having a weight average molecular weight of 71,000 was used, and the high density polyethylene used had an average molecular weight of 4,000.

The following copying test was carried out by using the so-obtained magnetic toners in the same manner as described in Example 3.

The obtained results are shown in Table 9. Incidentally, the image density was measured on a solid black portion.

The obtained copies had a black image excellent in the sharpness even at a high copying speed, and the half tone-reproducing property was excellent. It was found that if the total magnetite content was lower than 40% based on the sum of the binder resin medium and the magnetic material, fogging became conspicuous, and if the total magnetite content was higher than 70%, reduction of the image density was observed.

By using the one-component type magnetic toner R, 10000 copies were formed by carrying out the copying operation continuously. In each of the obtained copies, the image density was higher than 1.55. In this case, the copying operation was conducted without fogging in a stable condition.

When the copying operation was carried out by using the toner prepared by using the agglomerated magnetite alone, the color hue of the obtained image was not purely black but was bluish black. When the toners prepared by using the five magnetites shown in Table 7 were used, the image density was generally low and the gradient characteristic and sharpness were inferior in the obtained copies.

TABLE 9

| Magnetic Toner | Image Density | Background Density | Color Hue of Image | Sharpness | Resolving Power (lines/mm) | Gradient Characteristic (stages) |
|---|---|---|---|---|---|---|
| P | 1.18 | 0.09 | black | good | 8.0 | 11 |
| Q | 1.43 | 0.09 | " | excellent | 8.0 | 12 |
| R | 1.52 | 0.09 | " | " | 8.0 | 12 |
| S | 1.53 | 0.10 | " | " | 8.0 | 12 |
| T | 1.50 | 0.12 | " | " | 7.1 | 12 |

What is claimed is:

1. A one-component type magnetic developer consisting essentially of a particulate shaped article of a composition comprising a binder resin comprising a homopolymer or copolymer of a vinyl aromatic monomer and/or an acrylic monomer and having a volume resistivity of at least $1\times10^{15}$ Ω-cm and a powdery magnetic material dispersed in the binder resin medium, wherein said magnetic material comprises (A) a non-pulverizing agglomerate consisting of fine cubic magnetite particles wherein said particles of magnetite are densely aggregated with one another and the particle size distribution of said agglomerate is not substantially changed even by 5 hours' ball mill treatment, said agglomerate having a particle size of 2 to 7 μm as measured by an electron microscope, and (B) magnetite particles having a particle size of 0.1 to 0.6 μm, said agglomerate (A) and said magnetite particles (B) being present at an (A)/(B) weight ratio of from 95/5 to 10/90, said developer being obtained by kneading and pulverizing said composition and having a particle size of 5 to 35 microns, which is at least two times the number average particle size of the agglomerate, said agglomerate having a saturation magnetization of 75 to 88 emu/g and residual magnetization of 3 to 12 emu/g and a coercive force of 40 to 150 Oe, the fine magnetite (B) having an apparent density larger than 0.45 g/ml, a shape anisotropy, defined as the ratio of the maximum size to the minimum size, of from 1.0 to 5.5, and consisting of cubic particles or rounded intermediate-shape particles, and each of the agglomerate (A) and the fine magnetite (B) being present in an amount of 35 to 75% by weight based on the sum of the amount of the binder resin medium and the powdery magnetic material.

2. A magnetic developer as set forth in claim 1, wherein the agglomerate has an apparent density of 0.5 to 1.5 as measured according to the method of JIS K-5101.

3. A magnetic developer as set forth in claim 1, wherein the agglomerate has substantially the same configuration as that shown in the electron microscope photograph of FIG. 1 of the accompanying drawings.

4. A magnetic developer as set forth in claim 1 wherein the agglomerate (A) has a particle size of 2 to 7 microns and an apparent density of 0.7 to 1.3 g/ml, as determined according to the method of JIS K-5101; and said magnetite particles (B) have a particle size of 0.3 to 0.8 microns and a shape anisotropy of from 1 to 3; the weight ratio (A)/(B) being from 90/10 to 40/60.

5. A magnetic developer as set forth in claim 1 wherein said composition comprises about 37 parts of a styrene/butyl methacrylate copolymer having a weight average molecular weight of about 27,000, about 38.5 parts of agglomerated magnetite having an apparent density ranging from about 0.635 to about 1.20 m/gl, a coercive force of 72 Oe, an apparent density of about 0.40 g/ml and a particle size of about 0.3 microns.

* * * * *